US005797372A

United States Patent [19]

Sugimoto

[11] Patent Number: 5,797,372

[45] Date of Patent: Aug. 25, 1998

[54] FUEL SUPPLYING APPARATUS FOR INTERNAL COMBUSTION ENGINE

[75] Inventor: Tomojiro Sugimoto, Toyota, Japan

[73] Assignee: Toyota Jidosha Kabushiki Kaisha, Toyota, Japan

[21] Appl. No.: 826,365

[22] Filed: Apr. 9, 1997

[30] Foreign Application Priority Data

Apr. 10, 1996 [JP] Japan ..... 8-088112

[51] Int. Cl.[6] ..... F02M 51/00

[52] U.S. Cl. ..... 123/491; 123/493

[58] Field of Search ..... 123/497, 492, 123/493, 481, 491

[56] References Cited

U.S. PATENT DOCUMENTS

| | | | |
|---|---|---|---|
| 5,355,859 | 10/1994 | Weber | 123/497 |
| 5,361,742 | 11/1994 | Briggs et al. | 123/506 |
| 5,379,741 | 1/1995 | Matysiewicz et al. | 123/497 |
| 5,398,655 | 3/1995 | Tuckey | 123/456 |
| 5,406,922 | 4/1995 | Tuckey | 123/497 |
| 5,579,738 | 12/1996 | Frischmuth et al. | 123/497 |
| 5,586,539 | 12/1996 | Yonekawa et al. | 123/458 |

FOREIGN PATENT DOCUMENTS

| | | | |
|---|---|---|---|
| 55-137349 | 10/1980 | Japan | 123/497 |
| 57-108427 | 7/1982 | Japan | 123/497 |
| 62-13769 | 1/1987 | Japan | 123/497 |
| 62-101875 | 5/1987 | Japan | 123/497 |
| 62-261660 | 11/1987 | Japan | 123/497 |
| 4-63929 | 2/1992 | Japan | 123/497 |
| 6-74120 | 3/1994 | Japan | 123/497 |
| 6-173805 | 6/1994 | Japan | 123/497 |
| 6-207566 | 7/1994 | Japan | 123/497 |

*Primary Examiner*—Raymond A. Nelli

*Attorney, Agent, or Firm*—Burns, Doane, Swecker & Mathis, LLP

[57] ABSTRACT

An apparatus for supplying fuel to an internal combustion engine is disclosed. The apparatus includes an injector that is selectively opened and closed and a pump for discharging the fuel to the injector from a fuel reservoir. The injector is open to inject the fuel to the engine when the engine is running and closed when the engine is idling. The amount of fuel to be injected is adjusted based on the operating state of the engine. A pressure sensor detects an actual pressure of the fuel to be supplied to the injector. A controller computes a target pressure of the fuel to be supplied to the injector. The controller determines a presumed change of engine speed based on the operating state of the engine and controls the pump based on the presumed change.

20 Claims, 6 Drawing Sheets

FUEL SUPPLYING APPARATUS FOR INTERNAL COMBUSTION ENGINE

BACKGROUND OF THE INVENTION

1. Field of the Invention

The present invention relates to an apparatus for supplying fuel to an internal combustion engine. More particularly, the present invention pertains to an apparatus for controlling the amount of fuel discharged from the injector in accordance with the operating state of the engine.

2. Description of the Related Art

A typical fuel supplying apparatus for an internal combustion engine is shown in FIG. 6. The apparatus Includes an electric pump 31, which draws in fuel from a fuel tank 32. The pump 31 pressurized and sends the fuel to a delivery pipe 35 by way of a fuel line 33 and a filter 34. The delivery pipe 35 distributes the fuel to a plurality of injectors 36, one of which is provided for each cylinder of an engine 37. Fuel is injected through the injectors 36 into the associated cylinders. A computer 38 computes the amount of fuel that is to be injected from each injector 36 in accordance with the operating state of the engine 37 and controls the injector 36 accordingly.

A pressure regulator 39 is provided in the delivery pipe 35 to adjust the fuel pressure in the pipe 35 and to maintain a constant relationship between the fuel pressure in the pipe 35 and the intake pressure in an Intake manifold 40. The regulator 39 returns excess fuel, which results from the fuel pressure adjustment, to the tank 32 through a return pipe 41. The regulator 39 has a sensing port 39*a*, which senses the intake pressure in the manifold 40. The intake pressure communicated through a pipe 42 is sensed by the sensing port 39*a* and referred to during the pressure adjustment.

In this apparatus, the fuel pressure at each injector 36 is maintained at a constant value. Thus, the amount of fuel injected from each injector 36 is determined by the time period during which the injector 36 is opened.

However, in this type of apparatus, the pump 31 is constantly operated when the engine 37 is operating to maintain constant fuel pressure at each injector 36. Thus, the pump 31 operates and continues to send pressurized fuel to the injectors 36 even when fuel is not needed and the injectors 36 are forcibly closed. In such a state, fuel is not injected from the injectors 36 and is returned to-the tank 32 by way of the delivery pipe 35, the pressure regulator 39, and the return line 41. This results in the pump 31 recirculating fuel. Thus, the pump 31 is operated in an inefficient manner.

In addition, since surplus fuel is returned to the tank 32 by the pressure regulator 39, surplus fuel is always conveyed through the delivery pipe 35. The, recirculation of surplus fuel indicates that the pump 31 is often operated inefficiently. This increases the electric power consumption of the pump 31 and causes an increase in the electric power load on the electric power source (such as a battery and an alternator) that powers the pump 31. Such power consumption leads to an increase in the fuel consumption of the engine 37.

Japanese Unexamined Patent Publication No. 57-108427 describes an apparatus that copes with the above problems. As apparent from FIG. 7, the pressure regulator 39 and the return line 41 employed in the above apparatus are not employed in this apparatus. A computer 53 controls the time period during which an injector 54 is opened in accordance with the operating state of an engine 52 to supply the required amount of fuel to the engine 52 from a fuel tank 51. The computer 53 simultaneously controls the amount of fuel discharged from a pump 55 in accordance with the operating state of the engine 52, and especially in accordance with the intake air amount and the speed of the engine 52. In other words, the computer 53 controls the fuel pressure at the injector 54 in accordance with the operating state of the engine 52.

However, the pump 55 is controlled in accordance with changes in the parameters of the intake air amount and the engine speed. Thus, when the engine 52 enters a transitional state (a state in which the engine speed is accelerating or decelerating), a delay in the changing of the control signals in accordance with the new parameter values takes place. Since control of the pump 55 follows the parameter changes, there are delays in the controlling of the pump 55. That is, a delay occurs until the fuel pressure communicated to the injector 55 reaches a target pressure. The delay may result in a lack of fuel injected from the injector 54. This may result in an inappropriate air-fuel ratio, which degrades engine performance and causes undesirable engine emissions.

SUMMARY OF THE INVENTION

Accordingly, it is an objective of the present invention to provide a fuel supplying apparatus for an internal combustion engine that improves the control of the amount of fuel injected from injectors during the transitional state of the engine, and improves the accuracy of the air-fuel ratio control.

It is a further objective of the present invention to provide a fuel supplying apparatus for an internal combustion engine that minimizes the load on the engine.

To achieve the above objectives, the present invention provides an apparatus for supplying fuel to an internal combustion engine that includes a selectively opened and closed injector and a pump for discharging the fuel to the injector from a fuel reservoir. The injector is opened to inject the fuel to the engine when the engine is running and closed when the engine is decelerating. An amount of the fuel to be injected is adjusted based on the operating state of the engine. The apparatus includes pressure detecting means for detecting the pressure of the fuel supplied to the injector, means for computing a target pressure of the fuel supplied to the injector, speed change determining means for determining a change of engine speed that is presumed based on the operating state of the engine, and pump control means for controlling the pump based on the presumed change of the engine speed. The pump control means includes calculating means for calculating a difference between the target pressure and the detected pressure of the fuel. The pump is driven to selectively increase and decrease the amount of the fuel discharged to the injector based on the calculated difference so as to substantially equalize the target pressure and the actual pressure.

BRIEF DESCRIPTION OF THE DRAWINGS

The featured of the present invention that are believed to be novel are set forth with particularity in the appended claims. The invention, together with objects and advantages thereof, may best be understood by reference to the following description of the presently preferred embodiments together with the accompanying drawings in which:

DETAILED DESCRIPTION OF THE PREFERRED EMBODIMENTS

A first embodiment of a fuel supplying apparatus for an internal combustion engine according to the present invention will now be described with reference to FIGS. I to 3.

Figure 1:
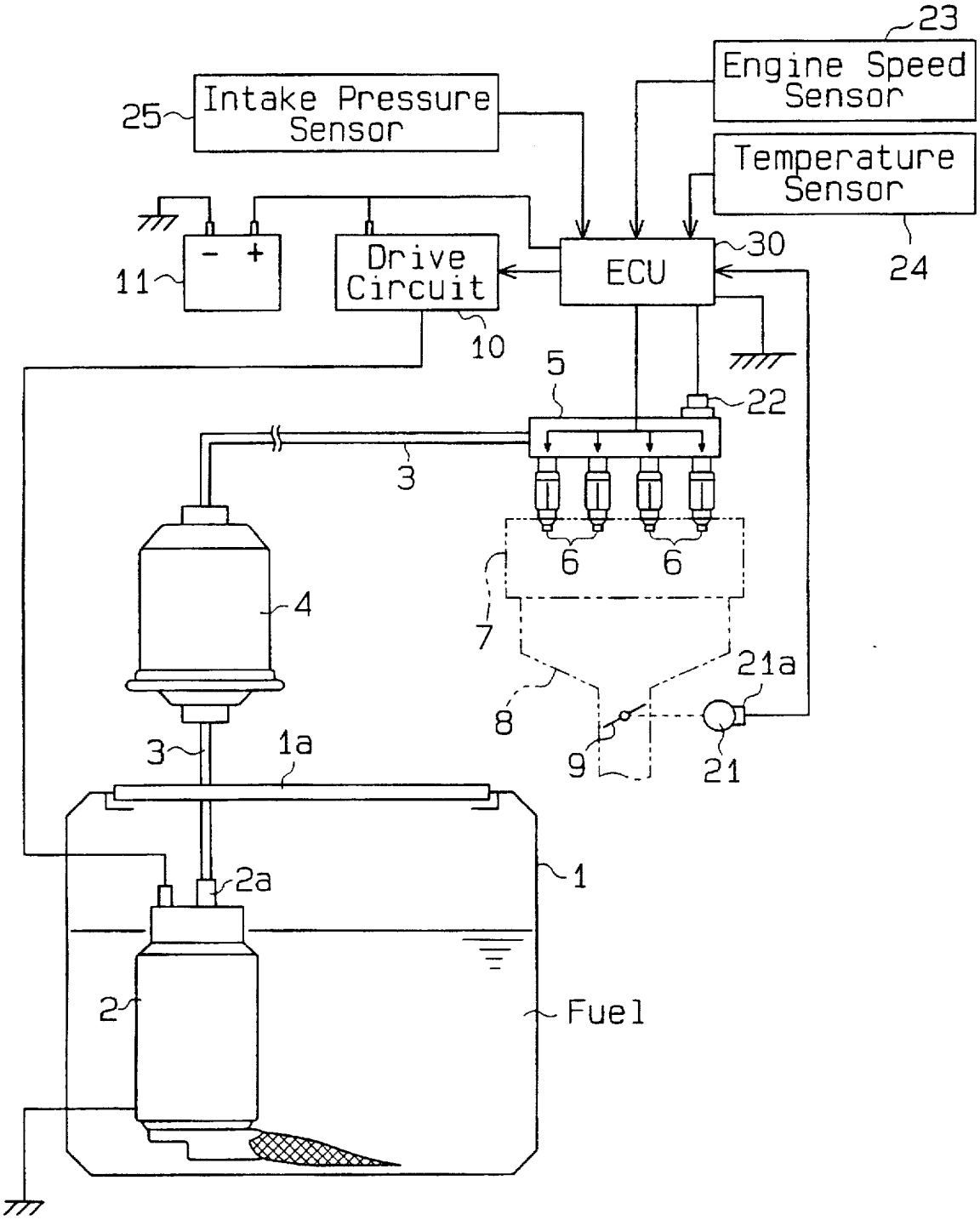
FIG. 1 is a diagrammatic view showing a first embodiment according to the present invention.

As shown in FIG. 1, a fuel supplying apparatus includes a fuel tank 1 and an electric pump 2, which is supported by brackets (not shown). The pump 2 incorporates a D.C. motor (not shown) and an impeller, which is driven by the motor. When the pump 2 is operated, the motor rotates the impeller and draws fuel into the pump 2 from the tank 1 and discharges the fuel through a discharge port 2*a*. The amount of fuel discharged from the pump 2, or the pressure of the fuel, is determined by the value of the electric current flowing through the motor. In other words, the discharged fuel amount and fuel pressure depends on the rotating speed of the impeller, which is driven by the motor.

A fuel line 3 connected to the discharge port 2*a* extends out of the tank 1 through an upper lid 1*a*. The fuel line 3 leads into a fuel filter 4 and further leads to a delivery pipe 5. A plurality of injectors 6 are provided in the delivery pipe 5. Each injector 6 corresponds to one of a plurality of cylinders of an engine 7 Each injector 6 includes a nozzle having an electromagnetic valve that is opened when energized and closed when de-enerized.

Air is drawn into the cylinders of the engine 7 through an intake passage 8 connected to the engine 7. A throttle valve 9 is provided in the intake passage 8. The throttle valve 9 is linked to an acceleration pedal (not shown). Manipulation of the acceleration pedal causes the throttle valve 9 to selectively open and close the intake passage 8. The opening area of the throttle valve 9 (throttle opening amount TA) is controlled to adjust the amount of air drawn into the cylinders (intake air amount Q).

The pump 2 pressurizes and sends the fuel from the tank 1 through the filter 4 and to the delivery pipe 5. The fuel is distributed to the injectors 6 in the delivery pipe 5. When opened, each injector 6 injects fuel into the corresponding cylinder. Combustion of the air-fuel mixture of the injected fuel and the air drawn in through the intake passage 8 rotates the crankshaft (not shown) of the engine 7.

A drive circuit 10 for driving the pump 2 supplies electric power to the pump 2 from a battery 11. The drive circuit 10 controls the value of the current flowing through the pump 2.

The opening amount TA of the throttle valve 9 is detected by a throttle sensor 21 arranged in the vicinity of the valve 9. A signal corresponding to the opening amount TA is sent from the throttle sensor 21 to an electronic control unit (ECU) 30. A conventional idle switch 21*a* is incorporated in the throttle sensor 21. The idle switch 21*a* is actuated when the throttle valve 9 is completely closed and sends an idle signal IDL indicating that the valve 9 is completely closed to the ECU 30.

A fuel pressure sensor 22 provided in the delivery pipe 5 detects the pressure of the fuel delivered to the injectors 6, or the fuel pressure in the delivery pipe 5 (fuel pressure PF). The pressure sensor 22 sends a signal that corresponds to the value of the detected fuel pressure to the ECU 30. An engine speed sensor 23 is provided in the engine 7 to detect the rotating speed of the crankshaft, or the engine speed NE. The speed sensor 23 detects a signal corresponding to the value of the detected speed to the ECU 30. The speed sensor 23 detects the rotating speed of the crankshaft by monitoring the rotational phase of the crankshaft as the crankshaft rotates by a predetermined angle. Pulse signals are successively sent to the ECU 30 in accordance with the detected results A temperature sensor 24 provided in the engine 7 detects the temperature of the coolant flowing through the engine 7, or the coolant temperature THW. The temperature sensor 24 sends a signal that corresponds to the value of the detected temperature to the ECU 30. An intake pressure sensor 25 is provided in the intake passage 8 to detect the intake pressure PM therein. The intake pressure sensor 25 sends a signal that corresponds to the value of the pressure detected by the pressure sensor 25.

The ECU 30 includes an input signal processing circuit, a memory, a computing circuit, and an output signal processing circuit. The sensors 21, 22, 23, 24, 25, the drive circuit 10, and the battery 11 are connected to the ECU 30. The ECU 30 controls the injectors 6 and the drive circuit 10, among other parts, based on the signals from the sensors 21, 21*a*, 22, 23, 24, 25 to control fuel injection and fuel supply.

The ECU 30 adjusts the time period during which each injector 6 is opened in accordance with the operating state of the engine 7 to control the amount of fuel injected from the injector 6 into the corresponding cylinder. Such control is referred to as fuel injection control.

The ECU 30 controls the drive circuit 10 in accordance with the operating state of the engine 7 and adjusts the amount of fuel discharged from the pump 2 to adjust the fuel pressure PF communicated to the injectors 6. Such control is referred to as fuel supply control.

Figure 2:
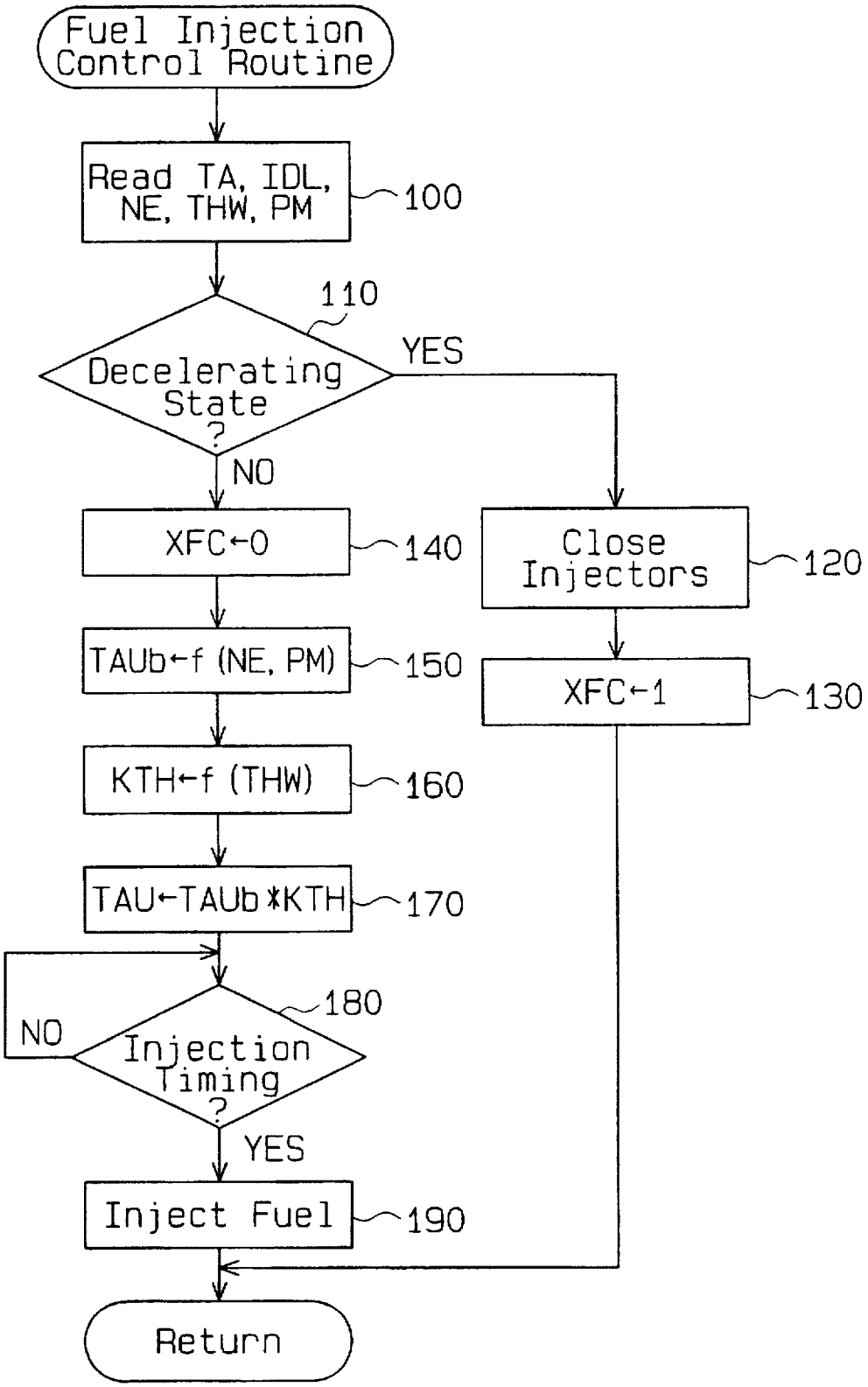
FIG. 2 is a flowchart showing a fuel injection control routine employed in the first embodiment.

FIG. 2 is a flowchart illustrating the steps of a routine executed during the fuel injection control. The ECU 30 executes this routine for every predetermined time interval in a cyclic manner when the engine 7 is running.

At step 100, the ECU 30 reads the values of the parameters that affect the running state of the engine 7, which are TA, IDL, NE, THW, PM respectively detected by the sensors 21, 21*a*, 23, 24, 25. At step 110, the ECU 30 determines whether the engine 7 is in a decelerating state based on the idle signal IDL. When the throttle valve 9 is completely closed indicating that the engine 7 is in a decelerating state, the ECU 30 proceeds to step 120. If the throttle valve 9 is opened and the engine 7 is not in a decelerating state, the ECU 30 proceeds to step 140.

When the engine 7 is in a decelerating state, the ECU 30 closes the injectors 6 to forcibly stop the injection of fuel into the associated cylinders and place the engine 7 in a fuel cut-off state at step 120. The ECU 30 then proceeds to step 130 and sets a fuel cut-off flag XFC to one to indicate that engine 7 is in a fuel cut-off state. The ECU 30 then temporarily terminates subsequent processing.

If determined that the engine 7 is not in a decelerating state in step 110, the ECU 30 proceeds to step 140 and sets the fuel cut-off flag XFC to zero to indicate that the engine 7 is not in a fuel cut-off state. At step 150, the ECU 30 computes the basic injection amount TAUb based on the values of the engine speed NE and the intake pressure PM. The value of the basic injection amount TAUb is in units of time. The ECU 30 computes the value of the basic injection amount TAUb by referring to function data predetermined from the parameters of the basic injection amount TAUb, the engine speed NE, and the intake pressure PM.

At step 160, the ECU 30 computes a temperature correction coefficient KTH based on the value of the coolant temperature THW. The ECU 30 computes the value of the correction coefficient KTH by referring to function data predetermined from the parameters of the temperature correction coefficient KTH and the coolant temperature THW. The value of the temperature correction coefficient KTH becomes greater as the value of the coolant temperature TRW becomes smaller.

At step 170, the ECU 30 multiplies the value of the basic injection amount TAUb with the value of the temperature correction coefficient KTH to compute a final fuel injection amount TAU. The fuel injection amount TAU is in units of time and is used to determine the time period during which the injectors 6 are opened. At step 180, the ECU 30 determines whether the time for injecting fuel into each cylinder has come. The injection timing is determined based on the pulse signal that is output from the speed sensor 23 in relation with the engine speed NE. When determined that the injection time has came, the ECU 30 proceeds to step 190 and opens the injectors 6 for the required time period that corresponds with the value of the computed fuel injection amount TAU. The ECU 30 than temporarily terminates subsequent processing.

Figure 3:
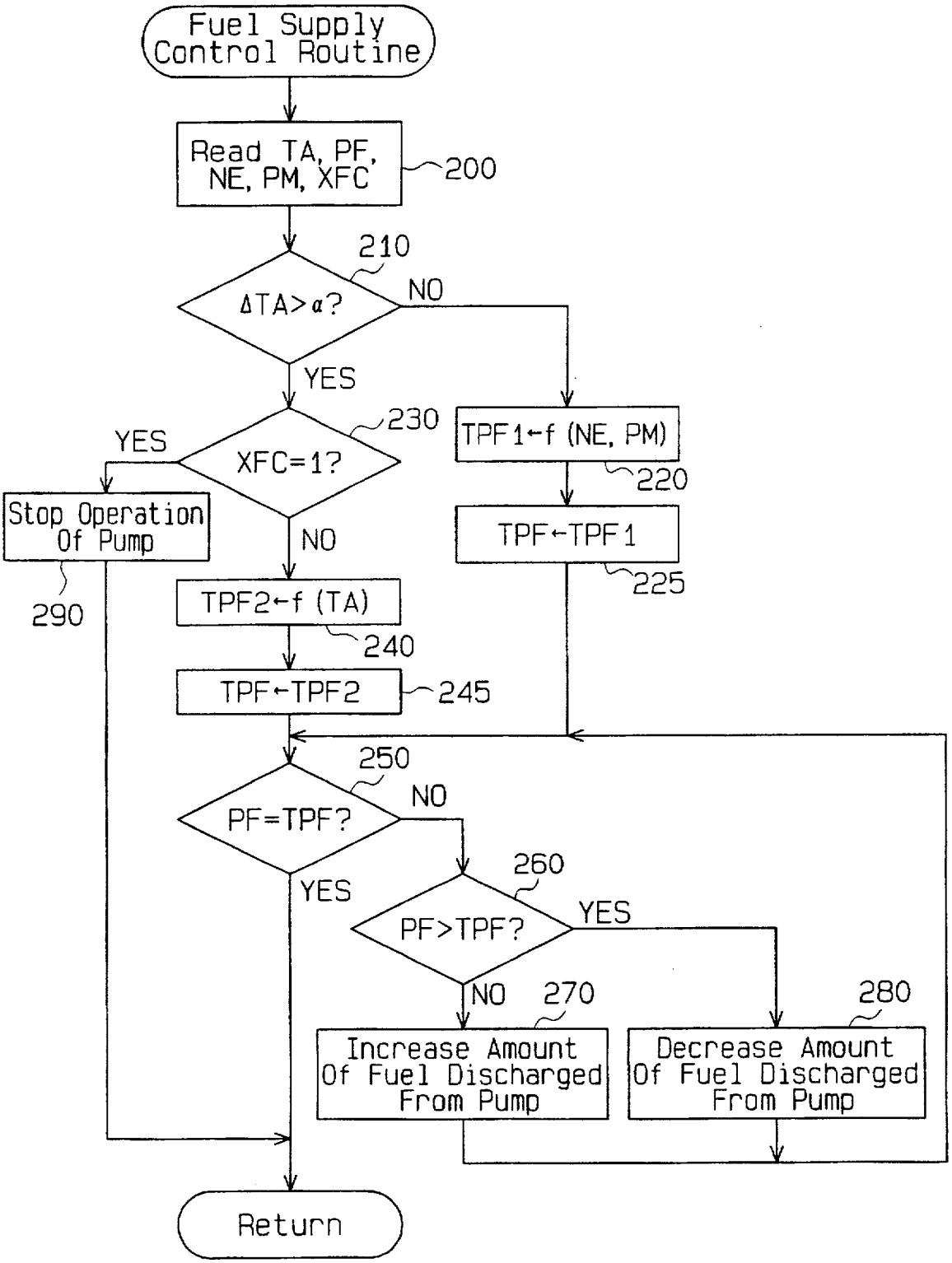
FIG. 3 is a flowchart showing a fuel supply control routine employed in the first embodiment.

FIG. 3 is a flowchart illustrating the contents of a routine executed during the fuel supply control. The ECU 30 executes this routine for every predetermined time interval in a cyclic manner when the engine 7 is running.

At step 200, the ECU 30 reads the parameters of TA, PF, NE, PM that are respectively detected by the sensors 21, 22, 23, 25. The ECU 30 also reads the value of the fuel cut-off flag XFC, which is set in the fuel injection control routine. At step 210, the ECU 30 computes an altering rate ΔTA of the throttle opening TA per unit time to determine whether the engine 7 is in a transitional state. The ECU 30 determines that the engine 7 is in a transitional state when the altering rate ΔTA is greater than a predetermined value α. If the altering rate ΔTA is equal to or smaller than the predetermined value α, the ECU 30 determines that the engine 7 is driven in a steady state.

If determined that the engine 7 is operating in a steady state in stop 210, the ECU 30 proceeds to stop 220. At step 220, the ECU 30 computes a target pressure TPF1 of the fuel pressure when the engine 7 is in the steady state based on the values of the engine speed NE and the intake pressure PM. The ECU 30 computes the target pressure TPF1 by referring to function data predetermined from the parameters of the target pressure TPF1, the engine speed NE, and the intake pressure PM. At step 225, the ECU 30 sets the target pressure TPF1 of the steady state as a final target pressure TPF.

From step 225, the ECU 30 proceeds to step 250 and determines whether the detected fuel pressure PF is equal to the target pressure TPF. When the actual fuel pressure PF is equal to the target pressure TPF, the ECU 30 terminates subsequent processing. If the fuel pressure PF differs from the target pressure TPF, the ECU 30 proceeds to step 260. At step 260, the ECU 30 determines whether the value of the actual fuel pressure PF is greater than the target pressure TPF. When it is determined that the fuel pressure PF is equal to or smaller than the target pressure TPF, the ECU 30 proceeds to step 270 and controls the drive circuit 10 to increase the value of the electric current flowing through the pump 2. This increases the amount of fuel discharged from the pump 2. The ECU 30 then returns to step 250. If it is determined that the fuel pressure PF is greater than the target pressure TPF in step 260, the ECU 30 proceeds to step 280 and controls the drive circuit 10 to decrease the value of the electric current flowing through the pump 2. This decreases the amount of fuel discharged from the pump 2. The ECU 30 then returns to step 250. In steps 250 to 280, the fuel amount discharged from the pump 2 is controlled to coincide the actual fuel pressure PF with the computed target pressure TPF (TPF1).

When the engine 7 is in a transitional state, the ECU 30 proceeds from step 210 to step 230 and determines whether the fuel cut-off flag. XFC is set at one. When the flag XFC is set at zero, this indicates that the engine 7 has not entered the fuel cut-off state during execution of the fuel injection control. Thus, the engine 7 is in an accelerating state. In this case, the ECU 30 proceeds to step 240. At step 240, the ECU 30 computes a target pressure TPF2 of the fuel pressure when the engine 7 is in an accelerating state based on the value of the throttle opening amount TA. The ECU 30 computes the target pressure TPF2 by referring to function data predetermined from the parameters of the target pressure TPF2 and the throttle opening amount TA. The target pressure TPF2 is used in steps 250, 260 to correct the target pressure TPF, which is compared with the actual fuel pressure PF, in accordance with the presumed changes that occur when the engine 7 is in a transitional state. The throttle opening amount TA is used as a parameter for presuming changes in the operating state of the engine 7.

At step 245, the ECU 30 sets the target pressure TPF2 as the final target pressure TPF. The ECU 30 then sequentially carries out steps 250 to 280 to coincide the actual fuel pressure PF with the target pressure TPF (TPF2).

In step 230, if it is determined that the fuel cutoff flag XFC is one, which indicates that the engine 7 has entered a fuel cut-off state during the fuel injection control, the ECU 30 proceeds to step 290. At step 290, the ECU 30 controls the drive circuit 10 and stops the electric current flowing through the pump 2. This de-activates the pump 2. Subsequent processing is then temporarily terminated.

As described above, the pump 2 is employed to pressurize and send fuel to the injectors 6 from the tank 1. The fuel is supplied to the cylinders of the engine 7 when injected through the injectors 6.

During the fuel injection control, the ECU 30 computes the value of the fuel injection amount TAU, which is necessary to operate the engine 7, based on parameters that include the values of the engine speed NE, the intake pressure PM, and the coolant temperature THW. The ECU 30 controls the amount of fuel injected into each cylinder by controlling the injectors 6 based on the computed value of the fuel injection amount TAU. The ECU 30 obtains the time period for opening the injectors 6 based on the fuel Injection amount TAU. In other words, the ECU 30 adjusts the time period during which each injector 6 is opened to control the amount of fuel injected from the injector 6.

During the fuel supply control, the ECU 30 computes the target pressure TPF of the fuel pressure PF that is to be communicated to each injector 6 based on the values of the parameters of the engine speed NE and the intake pressure PM that are related to the operating state of the angina 7. The ECU 30 controls the amount of fuel discharged from the pump 2 by controlling the drive circuit 10 so as to coincide the value of the actual fuel pressure PF, which is detected by the pressure sensor 22, with the computed target pressure TPF. In this manner, the amount of fuel supplied to each cylinder through the associated injector 6 is determined by the cooperation between the adjustment of the fuel pressure PF communicated to each injector 6 and the adjustment of the time period during which each injector 6 is opened. Thus, the amount of injected fuel is adjusted in accordance with the operating state of the engine 7.

When the operating state of the engine 7 changes drastically during the transitional state, the fuel pressure PF required by each injector 6 also changes drastically. If the target pressure TPF (TPF1) is computed in real time in the same manner as when the operation of the engine 7 is in a steady state, the computation of the target pressure TPF (TPF1) is delayed with respect to the fuel pressure PF that is required by the injectors 6. However, in this embodiment, when it is determined that the engine 7 is operating in a transitional state, the ECU 30 presumes the changes in the operating state of the engine 7 and corrects the target pressure TPF (TPF2) accordingly, which is to be compared with the actual fuel pressure PF, to control the pump 2.

Therefore, when the engine 7 is in a transitional state, and especially during acceleration, the computation delay of the target pressure TPF for the fuel pressure PF is corrected by presuming changes in the operating state of the engine 7. As a result, this prevents the amount of fuel injected through the injectors from becoming insufficient during acceleration of the engine 7. It also keeps the air-fuel ratio within a desirable range. This prevents degradation in the performance of the engine 7 and reduces undesirable engine emissions.

In this embodiment, when the engine 7 is in a fuel cut-off state, the operation of the pump 2 is stopped. Thus, the pump 2 is operated in a more efficient manner than when the pump 2 is always being operated. This reduces the power consumption of the pump 2. As a result, the power drain on the battery 11 decreases. This lowers the load of the pump 2 on the battery 11 and prolongs the life of the pump 2 and the battery 11. Furthermore, the de-activation of the pump 2 reduces noise that is generated from the pump 2.

In this embodiment, the pump 2 is controlled so as to coincide the detected fuel pressure PF with the target pressure TPF. Thus, when the engine 7 returns to a steady operating state from a fuel cut-off state, which takes place during deceleration, the fuel pressure PF in the delivery pipe 5, which is decreased during fuel cut-off, is immediately adjusted so as to coincide with the target pressure TPF. This readily supplies the amount of fuel required in each cylinder and guarantees the responsiveness of the engine 7 after returning from a fuel cut-off state.

Since this embodiment does not employ the pressure regulator and the return line like the prior art apparatus shown in FIG. 8, the size of the entire apparatus may be minimized.

The basic injection amount TAUb used to compute the fuel injection amount TAU is corrected by the temperature correction coefficient KTH. This allows computation of a fuel injection amount TAU that appropriately corresponds to the temperature of the engine 7. Thus, when the engine 7 is in an accelerating state, the amount of fuel injected from each injector 6 may be adjusted optimally.

In this embodiment, tho transitional operating state of the engine 7 is confirmed based on the throttle opening TA detected by the throttle sensor 21 and the idle signal IDL sent from the idle switch 21*a*. This enables the transitional state of the engine 7 to be readily confirmed.

A second embodiment according to the present invention will hereafter-be described with reference to the flowcharts of FIGS. 4 and S. In this embodiment, the processing steps of the fuel supply control routine differ from the first embodiment.

Figure 4:
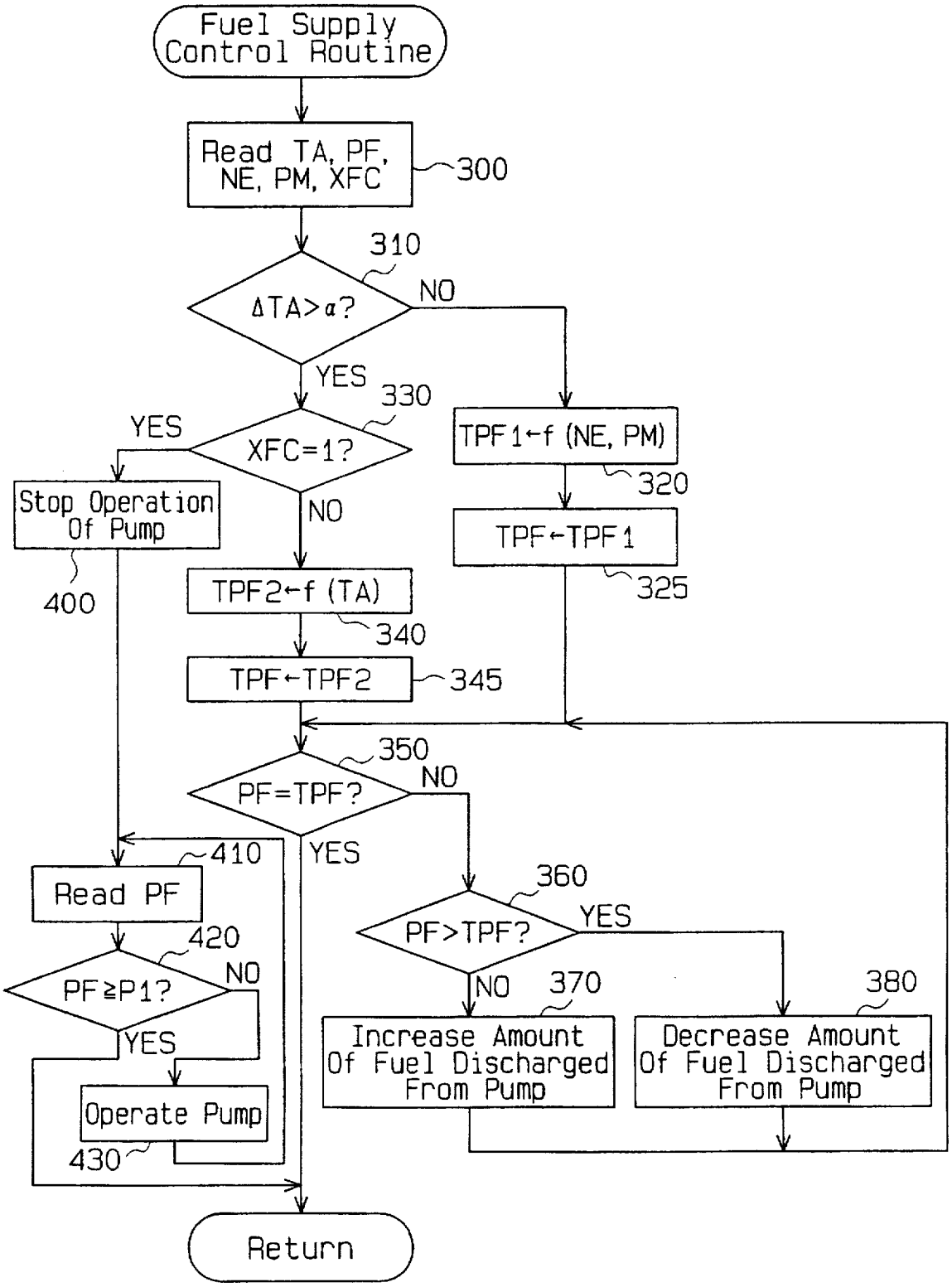
FIG. 4 is a flowchart showing a fuel supply control routine of a second embodiment.

The steps 300 to 380 shown in FIG. 4 respectively match steps 200 to 280 shown in FIG. 3. In this embodiment, steps 400, 410, 420, 430, which are executed after entering the fuel cut-off state, differ from the first embodiment.

The ECU 30 proceeds to step 400 from step 330 if the fuel cut-off flag XFC is confirmed to be one indicating that the engine 7 has entered a fuel cut-off state when executing the fuel injection control. At step 400, the ECU 30 controls the drive circuit 10 and stops the supply of electric power to the pump 2. This stops the operation of the pump 2. At step 410, the ECU 30 reads the value of the fuel pressure PF detected by the pressure sensor 22 after the engine 7 enters the fuel cut-off state.

At step 420, the ECU 30 determines whether the value of the fuel pressure PF is equal to or greater than a predetermined reference pressure P1. The reference pressure P1 is the minimum pressure value at which fuel may be sufficiently injected from the injectors 6 when returning from a fuel cut-off state. If the value of the fuel pressure PF is equal to or greater than the reference pressure P1, the ECU 30 temporarily terminates subsequent processing. When the value of the fuel pressure PF is smaller than the reference pressure Pi, the ECU 30 determines that the amount of fuel injected from the injectors 6 may become insufficient when the engine 7 returns from the fuel cut-off state. The ECU 30 then proceeds to step 430.

At step 430, the ECU 30 controls the drive circuit 10 and supplies a slight amount of electric power to the pump 2. This causes the pump 2 to discharge the required amount of fuel. After the execution of step 430, the ECU 30 returns to step 310 and repeats steps 410 to 430 as required.

In this embodiment, the value of the fuel pressure PF that is to be communicated to the injectors 6 is not permitted to fall below the reference pressure P1 when the engine 7 enters a fuel cut-off state. Thus, when the engine 7 returns to a steady operating state from a fuel cut-off state, or decelerating state, a satisfactory efficient amount of fuel may readily be injected from the injectors 6.

Thus, when returning from a fuel cut-off state, the necessary amount of fuel may be charged into each cylinder. This enhances the responsiveness of the engine 7 when returning to a steady operating state. This embodiment is especially effective when the engine 7 remains in a fuel cut-off state over a long period of time.

Figure 5:
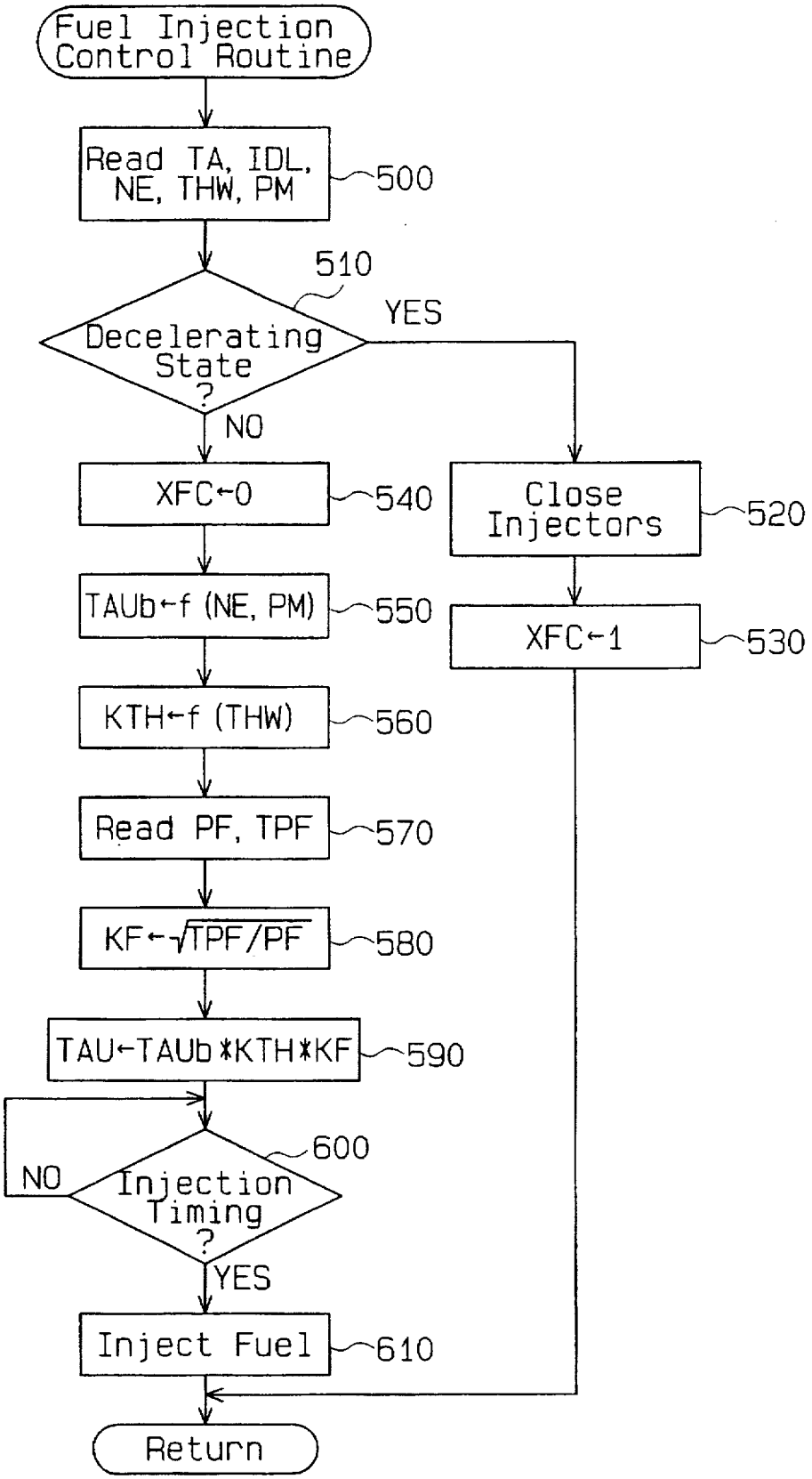
FIG. 5 is a flowchart showing a fuel injection control routine employed in the second embodiment.
Figure 6:
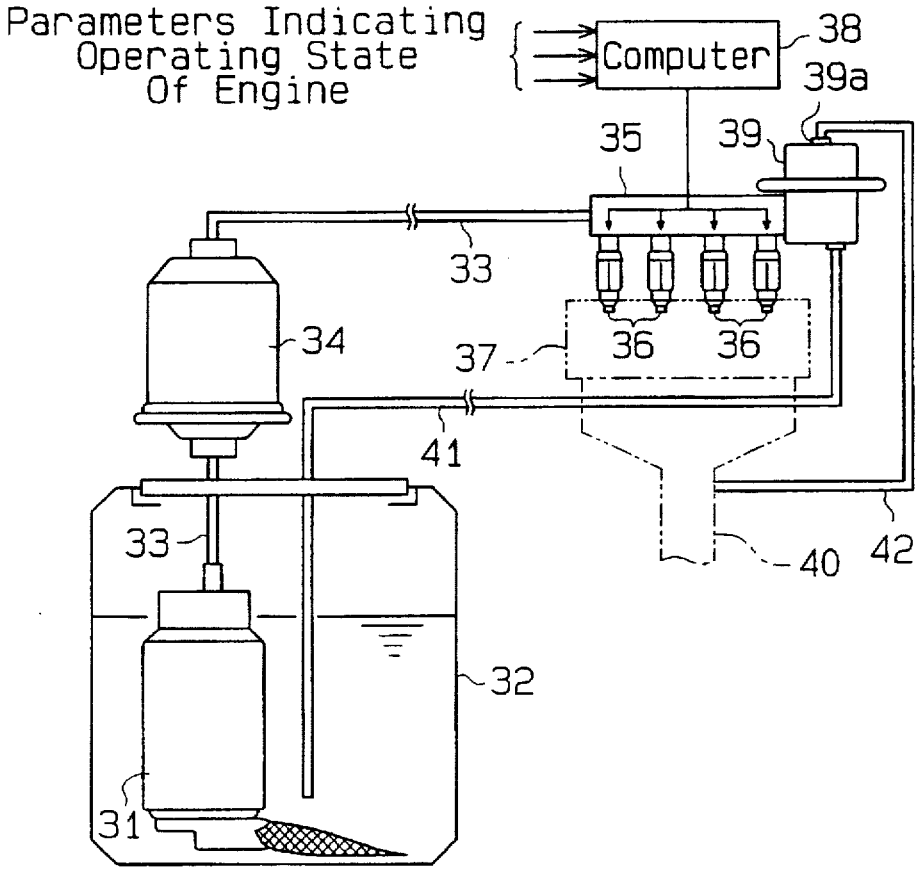
Fig.6(Prior Art)
FIG. 6 is a diagrammatic view showing a prior art fuel supplying apparatus.
Figure 7:
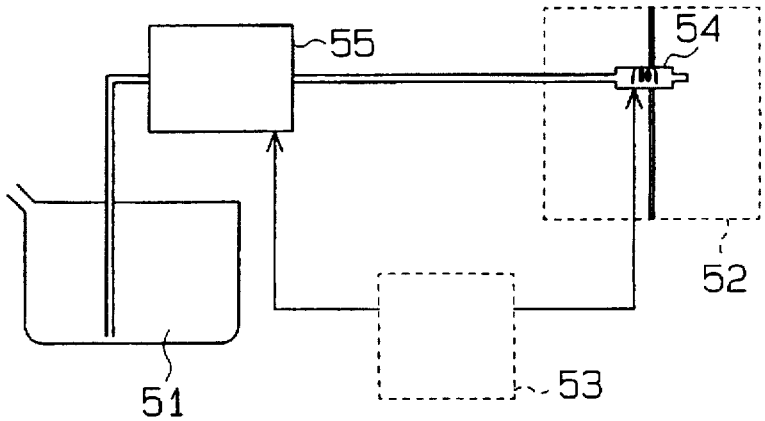
Fig.7(Prior Art)
FIG. 7 is a diagrammatic view showing another prior art fuel supplying apparatus.

The fuel injection control routine of the second embodiment will now be described with reference to FIG. 5. The steps 500, 510, 520, 530, 540, 550, 560, 600, 610 shown in FIG. 5 respectively match steps 100, 110, 120, 130, 140, 150, 160, 180, 190 shown in FIG. 2. In this embodiment, the steps 400, 410, 420, which are executed to compute the fuel injection amount TAU when the engine 7 is in a decelerating state, differ from the first embodiment.

After computation of the temperature correction coefficient KTH, the ECU 30 proceeds to step 570 and reads the value of the fuel pressure PF, which is detected by the pressure sensor 22. The ECU 30 also reads the value of the target pressure TPF, which has been computed during the fuel supply control routine. At step 580, the ECU 30 obtains the fuel correction coefficient KF, which is used to correct the fuel amount that is to be supplied to each injector 6, by computing the square root of the ratio between values of the computed target pressure TPF and the actual fuel pressure PF. At step 590, the ECU 30 multiplies the value of the basic injection amount TAUb with the temperature correction coefficient KTH and the fuel correction coefficient KF to obtain the final fuel injection amount TAU.

This embodiment differs from the first embodiment in that the fuel correction coefficient KF for the fuel injection amount TAU is computed by obtaining the square root of the ratio between the values of the computed target pressure TPF and the actual fuel pressure PF. The ECU 30 computes the final fuel injection amount TAU by correcting the value of the basic injection amount TAUb with the value of the computed fuel correction coefficient RF.

Therefore, when the engine 7 is in a transitional state, and especially when the engine 7 is in an accelerating state, the computation delay of the target pressure TPF for the fuel pressure PF is readily corrected by correcting the basic injection amount TAUb with the fuel correction coefficient KF. The correction of the fuel injection amount TAU readily and optimally adjusts the fuel amount, which is supplied to the engine 7 by each injector 6. As a result, this prevents the amount of fuel injected through the injectors 6 from becoming insufficient when the engine 7 is in an accelerating state. It also prevents an undesirable air-fuel ratio. Thus, degradation in the performance of the engine 7 is prevented and undesirable engine emissions are suppressed.

Although only two embodiments of the present invention have been described so far, it should be apparent to those skilled in the art that the present invention may be embodied in many other specific forms without departing from the spirit or scope of the invention. For example, the present invention may be modified as described below.

In the above embodiments, the operation of the pump 2 is stopped when the engine 7 is in a fuel cut-off state.

However, instead of stopping the pump 2, the pump 2 may be operated so as to continuously discharge a minimum amount of fuel. On the other hand, the pump 2 may be kept in a normal operating state instead of stopping operation or discharging a minimum amount of fuel when the engine is in a fuel cut-off state.

In the above embodiments, the transitional state of the engine 7 is determined based on changes in the throttle opening amount TA, which is detected by the throttle sensor 21, and the idle signal IDL, which is sent from the idle switch 21*a*. However, the transitional state of the engine 7 may be determined based on the intake pressure PM detected by the intake pressure sensor 25 or the engine speed NE detected by the speed sensor 23.

In the above embodiments, the fuel pressure PF is detected by the pressure sensor 22 arranged in the delivery pipe 5. However, the fuel pressure PF may be detected by arranging a pressure sensor in the fuel line 3.

Therefore, the present examples and embodiments are to be considered as illustrative and not restrictive and the invention is not to be limited to the details given herein, but may be modified within the scope of the appended claims.

What is claimed is:

1. An apparatus for supplying fuel to an internal combustion engine including a selectively opened and closed injector and a pump for discharging the fuel to the injector from a fuel reservoir, wherein an amount of fuel to be injected is adjusted based on an operating state of the engine, said apparatus comprising:

pressure detecting mean's for detecting the pressure of the fuel supplied to the injector;

means for computing a target pressure of the fuel supplied to the injector;

speed change determining means for determining a change of engine speed that is presumed based on the operating state of the engine; and pump control means for controlling the pump based on the presumed change of the engine speed, said pump control means including calculating means for calculating a difference between the target pressure and the detected pressure of the fuel, wherein said pump is driven to selectively increase and decrease the amount of fuel discharged to the injector based on the calculated difference between the target pressure and the detected pressure of the fuel so as to substantially equalize the target pressure and an actual pressure of the fuel supplied to the injector.

2. The apparatus as set forth in claim 1 further comprising:

a sensor for sensing engine speed; and injector control means for opening the injector based on the sensed engine speed.

3. The apparatus as set forth in claim 2 further comprising:

decelerating determining means for determining deceleration of the engine, wherein said injector control means forcibly closes the injector when the decelerating determining means determines that the engine is decelerating, and wherein said pump control means stops driving the pump when the injector is closed.

4. The apparatus as set forth in claim 3, wherein said pump control means includes:

comparing means for comparing a residual fuel pressure in the vicinity of the injector with a predetermined value after the pump is stopped; and driving means for driving the pump when the residual fuel pressure is smaller than the predetermined value.

5. The apparatus as set forth in claim 4, wherein said injector control means adjusts a time period of said opening of the injector to control the amount of the fuel that is to be injected to the engine.

6. The apparatus as set forth in claim 5 further comprising:

an air pressure sensor for sensing the pressure of air flowing to the engine;

a temperature sensor for sensing the temperature of coolant cooling the engine;

said injector control means including time period calculating means for calculating a basic time period of said opening based on the angina speed and the air pressure: and said injector control means including correcting means for correcting the basic time period of the opening based on the coolant temperature.

7. The apparatus as set forth in claim 6, wherein said correcting means corrects the basic time period based on a square root of a deviation of the actual pressure from the target pressure in addition to the coolant temperature.

8. The apparatus as set forth in claim 7 further comprising:

a throttle sensor for sensing an amount of air flowing to the engine, and wherein said speed change determining means determines the presumed change of the engine speed based on the sensed amount of the air.

9. The apparatus as set forth in claim 8, wherein the pump control means, the injector control means, the speed change determining means, the idle determining means, the calculating means, the comparing means, and the driving means are comprised by an electronic control unit.

10. An apparatus for supplying fuel to an internal combustion engine including a selectively opened and closed injector and a pump for discharging fuel to the injector from a fuel reservoir, wherein said pump is controlled based on parameters indicative of a operating state of the engine, said apparatus comprising:

decelerating determining means for determining deceleration of the engine, wherein said injector is forcibly closed when the decelerating determining means determines that the engine is decelerating, and wherein said pump is stopped when the injector is closed.

11. The apparatus as set forth in claim 10, including pump control means for controlling the pump, said pump control means including:

comparing means for comparing a residual fuel pressure in the vicinity of the injector with a predetermined value after the pump is stopped; and driving means for driving the pump when the residual fuel pressure is smaller than the predetermined value.

12. An apparatus for supplying fuel to an internal combustion engine including a selectively opened and closed injector and a pump for discharging fuel to the injector from a fuel reservoir, wherein an amount of fuel to be injected is adjusted based on an operating state of the engine, and wherein engine speed is changeable based on an amount of air flowing through a throttle valve in an air intake passage communicating with the engine, said apparatus comprising:

a throttle sensor for detecting an opening size of the throttle valve;

pressure detecting means for detecting the pressure of the fuel to be supplied to the injector;

means for computing a target pressure of the fuel to be supplied to the injector;

speed change determining means for determining a change of engine speed that is presumed based on the detected opening size of the throttle valve; and pump control means for controlling the pump based on the presumed change of the engine speed, said pump control means including calculating means for calculating a difference between the target pressure and the detected pressure of the fuel, wherein said pump is driven to selectively increase and decrease the amount of the fuel discharged to the injector based on the calculated difference between the target pressure and the detected pressure of the fuel so as to substantially equalize the target pressure and a actual pressure of the fuel supplied to the injector.

13. The apparatus as set forth in claim 12 further comprising:

a sensor for sensing engine speed; and injector control means for controlling opening time period of the injector based on the sensed engine speed.

14. The apparatus as set forth in claim 13 further comprising:

decelerating determining means for determining deceleration of the engine, wherein said injector control means forcibly closes the injector when the decelerating determining means determines that the engine is decelerating, and wherein said pump control means stops driving the pump when the injector is closed.

15. The apparatus as net forth in claim 14, wherein said pump control means includes:

comparing means for comparing a residual fuel pressure in the vicinity of the injector with a predetermined value after the pump is stopped; and driving means for driving the pump when the residual fuel pressure is smaller than the predetermined value.

16. The apparatus an set forth in claim 15, wherein said injector control means adjusts a time period of said opening of the injector to control the amount of the fuel that is to be injected to the engine.

17. The apparatus as set forth in claim 16 further comprising:

an air pressure sensor for sensing the pressure of air flowing to the engine;

a temperature sensor for sensing the temperature of coolant cooling the engine;

said injector control means including time period calculating means for calculating a basic time period of said opening based an the engine speed and the air pressure; and said injector control means including correcting means for correcting the basic time period of the opening based on the coolant temperature.

18. The apparatus as set forth in claim 17, wherein said correcting means corrects the basic time period based on a square root of a deviation of the actual pressure from the target pressure in addition to the coolant temperature.

19. An apparatus for controlling a fuel supply to an internal combustion engine including at least one fuel injector for injecting fuel into a cylinder, a fuel pump for supplying the fuel to the injector and a sensor for sensing the magnitude of at least one of the amount and the pressure of air flowing to the engine through a throttle valve so as to drive the engine based on the sensed magnitude, said injector being controlled by control means to inject an optimal amount of the fuel to the cylinder according to the operating state of the engine, said apparatus comprising:

first means in said control means for carrying out a routine for controlling the injector and second means in said controlling means for carrying out a routine for controlling the pump based on the sensed magnitude.

20. The apparatus as set forth in claim 19 further including:

idle determining means for determining idling of the engine, wherein said first means is arranged to forcibly close the injector in accordance with the idling of the engine, and wherein said second means is arranged to stop the pump when the injector is closed.

* * * * *